US011560255B2

(12) United States Patent
Oki et al.

(10) Patent No.: US 11,560,255 B2
(45) Date of Patent: Jan. 24, 2023

(54) CAN LID

(71) Applicant: TOYO SEIKAN CO., LTD., Tokyo (JP)

(72) Inventors: Takahiro Oki, Yokohama (JP); Atsushi Kominami, Yokohama (JP); Ryotaro Isomura, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 17/044,556

(22) PCT Filed: Apr. 3, 2019

(86) PCT No.: PCT/JP2019/014849
§ 371 (c)(1),
(2) Date: Oct. 1, 2020

(87) PCT Pub. No.: WO2019/194237
PCT Pub. Date: Oct. 10, 2019

(65) Prior Publication Data

US 2021/0155371 A1 May 27, 2021

(30) Foreign Application Priority Data

Apr. 3, 2018 (JP) ..... JP2018-071631

(51) Int. Cl.
*B65D 17/34* (2006.01)
*B65D 17/28* (2006.01)

(52) U.S. Cl.
CPC ..... *B65D 17/34* (2018.01); *B65D 17/4012* (2018.01); *B65D 2517/0013* (2013.01);
(Continued)

(58) Field of Classification Search
USPC ..... 220/260, 270, 269, 266; 413/25, 12
See application file for complete search history.

(56) References Cited

U.S. PATENT DOCUMENTS 5,653,355 A * 8/1997 Tominaga ..... B65D 17/4012 220/269
2014/0263320 A1* 9/2014 Forrest ..... B65D 17/4012 220/231
2014/0263329 A1* 9/2014 Chasteen ..... B65D 17/4012 220/270

FOREIGN PATENT DOCUMENTS

EP 2607255 A1 * 6/2013 ..... B65D 17/4011
JP H09-010874 A 1/1997
(Continued)

OTHER PUBLICATIONS

International Search Report issued in PCT Patent Application No. PCT/JP2019/014849 dated Jun. 18, 2019.
(Continued)

*Primary Examiner* — Valentin Neacsu
*Assistant Examiner* — John Martin Hoppmann
(74) *Attorney, Agent, or Firm* — Marshall, Gerstein & Borun LLP

(57) ABSTRACT

In an easy open can lid a pulling-up direction of a tab acts toward a center of the lid while securing a finger hooking property with respect to the tab, by devising a shape of an embossed portion. In a can lid in which a tab for score breaking is fixed to a main body, and an embossed portion, into which a fingertip is insertable, is provided in the vicinity of a rear end of a finger hook portion of the tab, the embossed portion has a slope formed at a rear end side of the finger hook portion, and the slope of the embossed portion is provided with a guide recess for guiding a fingertip that extends toward the center of the lid at least up to a position thereof facing a central portion in a width direction of a back surface of the finger hook portion.

11 Claims, 7 Drawing Sheets

(52) U.S. Cl.
CPC ..... *B65D 2517/0014* (2013.01); *B65D 2517/0079* (2013.01)

(56) References Cited

FOREIGN PATENT DOCUMENTS

| | | | | | |
|---|---|---|---|---|---|
| JP | 2010-070225 | A | | 4/2010 | |
| JP | 2010070225 | A | * | 4/2010 | |
| JP | 2012-030825 | A | | 2/2012 | |
| JP | 2012-236624 | A | | 12/2012 | |
| JP | 2012236624 | A | * | 12/2012 | |
| JP | 2015-071436 | A | | 4/2015 | |
| JP | 2015-085962 | A | | 5/2015 | |
| JP | 5741198 | B2 | | 7/2015 | |
| JP | 2017214103 | A | * | 12/2017 | |
| KR | 20160000801 | U | * | 3/2016 | |
| WO | WO-2017151419 | A1 | * | 9/2017 | ..... B65D 39/084 |

OTHER PUBLICATIONS

Extended European Search Report issued in European Patent Application No. 19780785.2 dated Dec. 10, 2021.

* cited by examiner

CAN LID

TECHNICAL FIELD

The present invention relates to an easy open can lid with improved tab openability.

BACKGROUND

As a conventional easy open can lid, there has been known the one described in Japanese Patent No. 5741198 ("JP 5741198"), for example. That is, a tab for score breaking is fixed to a can lid main body. The tab is fixed at a rivet portion provided in the center of a can lid, and has one end thereof overlapped with a portion expected to be opened, and the other end thereof extended to the vicinity of a peripheral edge of the can lid. When opening the opening expected portion, a finger is hooked on a rear end of a finger hook portion located at the other end of the tab, and the tab is pulled up with the rivet portion as a fulcrum, whereby the opening expected portion of the can lid main body is pressed downward by the tab tip end portion, and a vertical shearing force is applied to a starting end portion of a score located between the rivet portion and the tab tip end portion to initially break the score, so that the score is sequentially broken along the periphery of the opening expected portion to form an opening.

In JP 5741198, the can lid main body is provided with an embossed portion in the vicinity of the rear end of the finger hook portion of the tab, and the interval between a bottom surface of the embossed portion and the finger hook portion is formed to be large, whereby the finger is easily hooked on the rear end of the finger hook portion of the tab, thereby enhancing opening operability of the tab. In particular, in JP 5741198, a tip-up portion is provided in the finger hook portion, thereby increasing the interval between the bottom surface of the embossed portion and the finger hook portion.

However, in the can lid of JP 5741198, a finger hooking property is improved by the embossed portion and the tip-up portion, but a movable range of the finger hooked on the rear end of the finger hook portion in a short side direction of the tab is so large that the finger may be displaced from the center of the finger hook portion, when the tab is pulled up, and the force acting on the tab may be obliquely applied with respect to a lid center direction. As a result, the force acting on the tab tip end portion may be reduced, thereby giving rise to a fear that defective opening or opening failure may be caused.

In addition, when the embossed portion and the tip-up portion are provided, the finger hooking property can be improved, but a gap of the can lid with respect to the panel surface becomes large, and hence, when can bodies with can lids seamed and fixed thereto are stacked, an upper can body may be inclined, so that a can bottom thereof may be hooked or caught on a finger hook portion of a tab of a lower can body, thereby enhancing a fear that unexpected or accidental opening of the lower can is likely to occur.

SUMMARY OF THE DISCLOSURE

An object of the present invention is to provide an easy open can lid in which a pulling-up direction of a tab can be made to act toward the center of the lid as much as possible while securing a finger hooking property with respect to the tab, by devising the shape of an embossed portion.

Another object of the present invention is to provide an easy open can lid in which a pulling-up direction of a tab can be made to act toward the center of the lid as much as possible, and which can prevent the occurrence of unintentional or accidental opening.

Solution to Problem

In order to achieve the above-mentioned object, according to the present invention, there is provided a can lid in which a tab for score breaking is fixed to a can lid main body, and an embossed portion, into which a fingertip is insertable, is provided in the vicinity of a rear end of a finger hook portion of the tab, characterized in that a slope of the embossed portion at a rear end side of the finger hook portion is provided with a guide recess for guiding a fingertip that extends toward a center of the can lid at least up to a position facing a central portion in a width direction of a back surface of the finger hook portion.

According to the present invention, after a finger is hooked on the rear end of the finger hook portion of the tab, the fingertip is guided to the width direction central portion side of the back surface of the finger hook portion by means of the guide recess, so that the tab can be accurately pulled up in a pulling-up direction toward the center of the lid body.

In addition, the present invention can be configured as follows.

1. The width of the guide recess is gradually narrowed toward the center of the can lid.

With this configuration, the fingertip is naturally guided to the central portion in the width direction of the back surface of the finger hook portion.

2. The bottom of the guide recess is an inclined surface that becomes gradually shallower from the bottom surface of the embossed portion toward the center of the can lid, and has an inclination angle smaller than that of the slope of the embossed portion at a side opposite to the center of the can lid.

In this way, the tab is raised or pulled up as the fingertip gradually lifts.

3. The embossed portion has a bottom surface and an inner peripheral wall surrounding the bottom surface, wherein the inner peripheral wall has a first slope at a side opposite to the can lid center, a second slope at a can lid center side, and a pair of side slopes connecting to the opposite ends of the first slope, and the pair of side slopes are inclined in directions gradually approaching each other toward the can lid center side, and together constitute a part of the guide recess.

With this configuration, the side slopes function as a part of the guide recess, so that the fingertip can be easily guided to the central portion in the width direction of the back surface of the finger hook portion.

4. The can lid main body is provided with convex portions in the vicinity of the rear end of the finger hook portion of the tab at opposite sides of the embossed portion that is sandwiched therebetween.

With this configuration, it is possible to prevent a finger from hooking on the rear end of the finger hook portion from other than the central portion in the width direction of the back surface of the finger hook portion, and it is also possible to prevent oblique opening by a finger, a jig, or the like. In addition, it is possible to prevent accidental opening of cans due to the stacking of the cans.

5. In particular, each of the convex portions has a slope at the side of the embossed portion, which is an inclined surface continuous with the adjacent side slope of the embossed portion.

With this configuration, when the fingertip is displaced from the enteral direction of the can lid, the finger comes into contact with the slopes of the high convex portions, so that it is more easily guided by the guide recess.

6. The height of each of the convex portions is in a range of 0.5 mm or more and 1.2 mm or less.

That is, if the height of each convex portion is set to about 0.5 mm or more, accidental opening will be less likely to occur even when the can lid with the tab is used in a positive pressure can in which floating or lifting of the tab occurs. A more preferable range is 0.7 mm or more. On the other hand, as the height of each convex portion is higher, the effect of suppressing the accidental opening becomes higher, but an amount of decrease in the thickness of each convex portion becomes larger, thereby causing problems in formability or moldability, such as insufficient strength, tearing or breakage of a coating film, etc. If the height of each convex portion is 1.2 mm or less, it falls within a level at which there is no practical problem.

7. A distance between apexes of the convex portions is set in a range of 13 mm±2 mm.

According to such a configuration, the finger is naturally guided to the guide recess from a finger hooking step or stage, and is then guided to the center of the back surface of the finger hook portion.

8. The can lid main body has a circular center panel, wherein the center panel has a first panel surface at an outer peripheral edge side thereof and a second panel surface, which is located at an inner side of the first panel surface and is lower by one step or level than the first panel surface via a stepped portion from an inner peripheral edge of the first panel surface, and the convex portions are arranged on the first panel surface.

With the arrangement of the convex portions on the first panel surface, an amount of reduction in the thickness of each convex portion can be suppressed, which is more advantageous than the second panel surface in terms of formability.

9. The embossed portion is arranged in a region of the second panel surface and close to the stepped portion between the first and second panel surfaces.

In addition, the embossed portion has a bottom surface and an inner peripheral wall surrounding the bottom surface, wherein the inner peripheral wall has a first slope at the side opposite to the can lid center, a second slope at the side of the can lid center, and a pair of side slopes connecting to the opposite ends of the first slope, the first slope and the side slopes being inclined surfaces whose upper ends continue to the first panel surface, the second slope being an inclined surface whose upper end continues to the second panel surface.

With this configuration, the fingertip inserted into the embossed portion is surrounded by the first slope and the side slopes which are higher than the second slope side, so that it can be easily guided to the guide recess in the second slope of low height.

In addition, according to another aspect of the present invention, there is provided a can lid in which a tab for score breaking is fixed to a can lid main body, and an embossed portion, into which a fingertip is insertable, is provided in the vicinity of a rear end of a finger hook portion of the tab, characterized in that the can lid main body is provided with convex portions in the vicinity of the rear end of the finger hook portion of the tab at opposite sides of the embossed portion that is sandwiched therebetween; and a height of each of the convex portions is set in a range of 0.5 mm-1.2 mm.

That is, if the height of each convex portion is set to about 0.5 mm or more, accidental opening will be less likely to occur, even in cases where an internal pressure acts on the can lid to cause it to bulge thereby to float or lift the tab, as in a positive pressure can. More preferably, the height of each convex portion is 0.7 mm or more. On the other hand, as the height of each convex portion is higher, the effect of suppressing the accidental opening becomes higher, but an amount of reduction in the thickness of each convex portion becomes larger, thus giving rise to problems in formability, such as insufficient strength, tearing or breakage of a coating film, etc. If the height of each convex portion is 1.2 mm or less, it falls within a level at which there is no practical problem.

Moreover, the movable range of the finger in the short side direction of the tab is limited by the convex portions sandwiching the embossed portion, and hence, the fingertip is guided to the central portion in the width direction of the finger hook portion, so that the direction of pulling up the tab is easily directed to the lid center direction.

In addition, in another aspect, the present invention can be configured as follows.

1. The distance between the apexes of the convex portions is set in a range of 13 mm±2 mm.

With this configuration, the fingertip is easily guided to the central portion in the width direction of the finger hook portion.

2. The can lid main body has a circular center panel, wherein the center panel has a first panel surface at an outer peripheral edge side thereof and a second panel surface, which is located at an inner side of the first panel surface and is lower by one step or level than the first panel surface via a stepped portion from an inner peripheral edge of the first panel surface, and the convex portions are arranged on the first panel surface.

With the arrangement of the convex portions on the first panel surface, an amount of reduction in the thickness of each convex portion can be suppressed, which is more advantageous than the second panel surface in terms of formability.

Advantageous Effects of the Invention

According to the present invention, after a finger is hooked on the rear end of the finger hook portion of the tab, the fingertip is guided to the width direction central portion side of the back surface of the finger hook portion by means of the guide recess, so that the tab can be accurately pulled up in a pulling-up direction toward the center of the lid body.

BRIEF DESCRIPTION OF THE DRAWINGS

FIGS. 1A to 1C illustrate a can lid according to an embodiment of the present invention, wherein FIG. 1A is a plan view, FIG. 1B is an enlarged cross section of main parts of FIG. 1A taken along a second center line N, and FIG. 1C is a partial cross section taken along line C-C of FIG. 1B.

FIGS. 3A to 3C are viewed from a rear end of a finger hook portion of a tab.

FIGS. 5A and 5B illustrate can bodies for evaluation tests, wherein FIG. 5A is a view showing a state in which class 1 type can bodies are stacked in two tiers, and FIG. 5B is a view showing a state in which class 2 type can bodies are stacked in two tiers.

DETAILED DESCRIPTION

Hereinafter, the present invention will be described in detail based on a preferred embodiment thereof as illustrated.

Figure 1A:
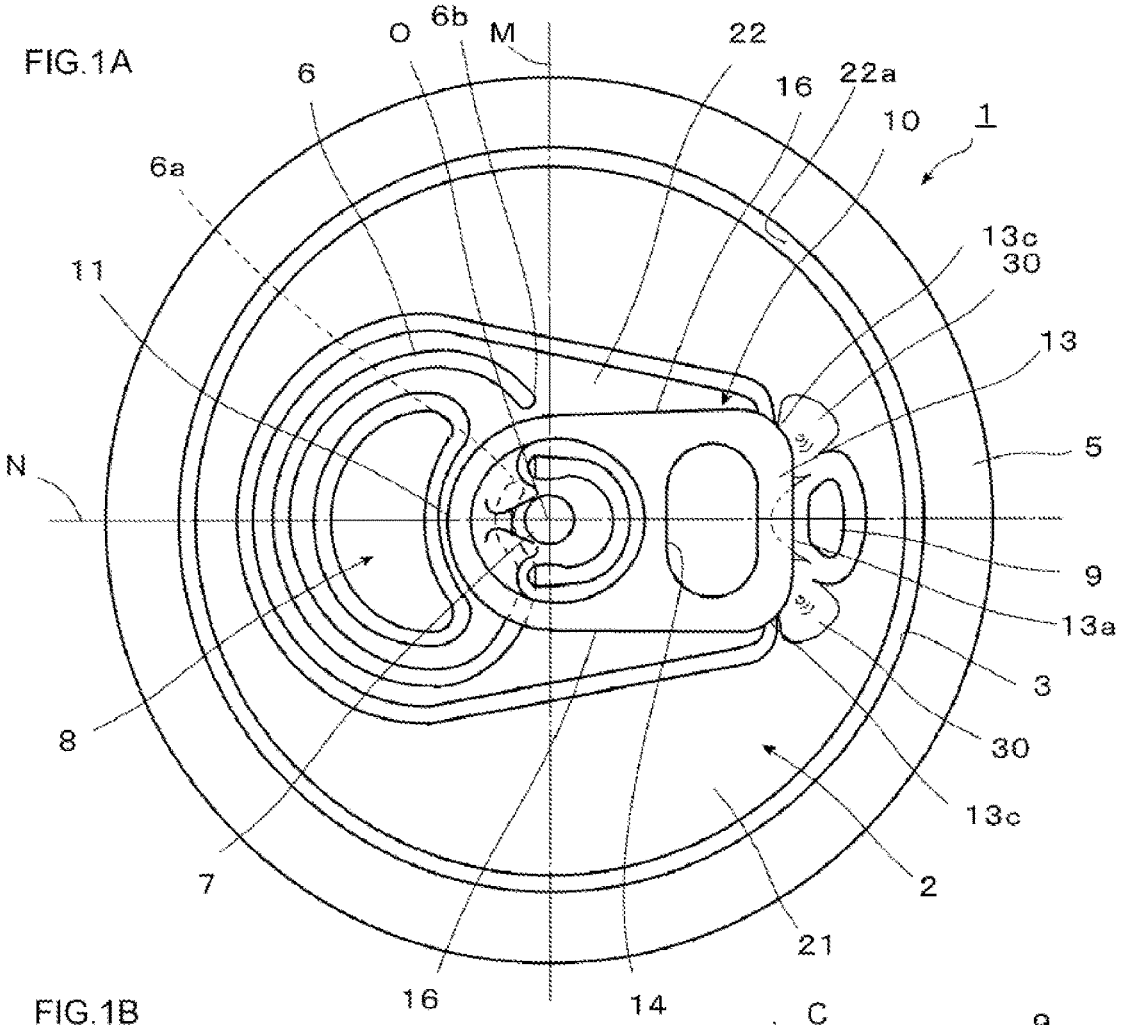
Figure 1B:
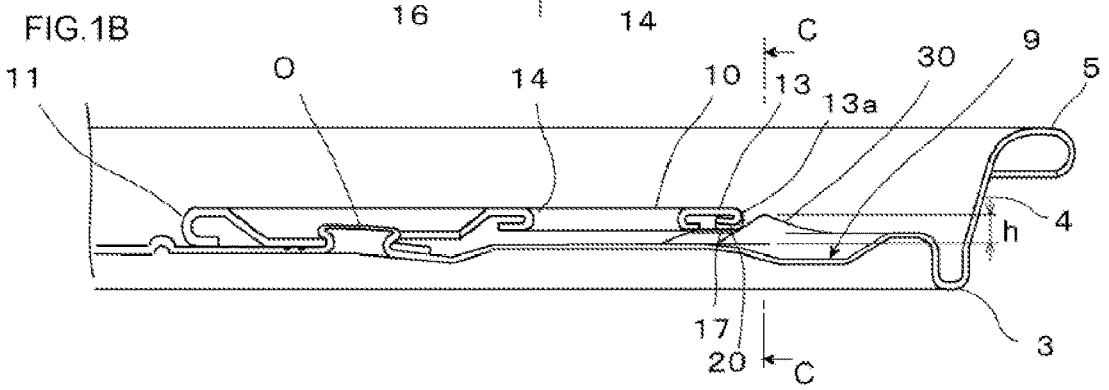
Figure 1C:
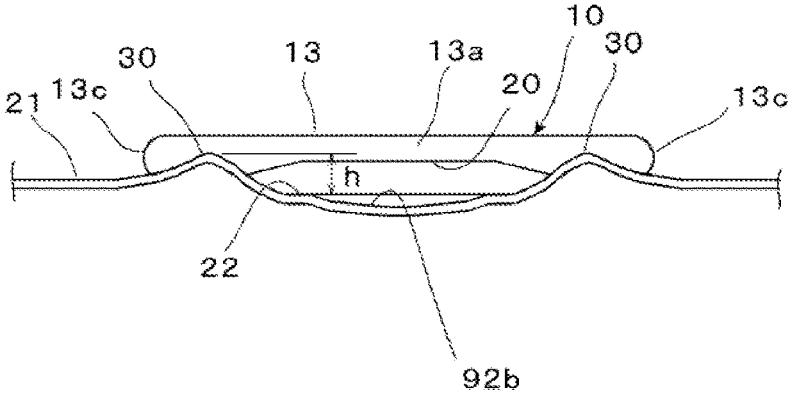

FIGS. 1A to 1C illustrate an easy open can lid according to the embodiment of the present invention.

That is, this easy open can lid is provided with a can lid main body 1 in which a score 6 surrounding an opening expected portion 8 serving as a spout is formed, and a tab 10 for score breaking fixedly attached to the can lid main body 1.

The can lid main body 1 has a circular center panel 2, a chuckwall radius 3 protruding downward from a peripheral edge of the center panel 2, a chuckwall 4 rising from an outer side wall of the chuckwall radius 3, and a seaming panel 5 formed continuously with the chuckwall 4. The center panel 2 has a first panel surface 21 at a panel peripheral edge side and a second panel surface 22, which is arranged at an inner side of the first panel surface 21 and constitutes a recessed portion that is lower by one step or level than the first panel surface 21, wherein the second panel surface 22 is divided from the first panel surface 21 by a stepped portion 22*b*, and the opening expected portion 8 and the tab 10 are arranged on the first panel surface 21.

The tab 10 is of a stay-on type, and is fixed to a rivet portion 7 projecting from a panel center O (can lid center) of the circular center panel 2. The opening expected portion 8 is formed in one semicircular region when the center panel 2 is divided in half by a first center line M passing through the panel center O, and the score 6 has a starting end portion 6*a* in the vicinity of the rivet portion 7, and extends to a terminal end 6*b* so as to surround the peripheral edge of the opening expected portion 8. The opening by the tab 10 is opened toward the terminal end 6*b* by initially breaking the starting end portion 6*a*.

The tab 10 is a plate-like member formed in a substantially track shape, wherein one end of the tab in the major axis direction is an arc-shaped tab tip end portion 11, and the other end thereof is a linear finger hook portion 13. The tab 10 is arranged along a second center line N passing through the panel center O and orthogonal to the first center line M, wherein the tab tip end portion 11 goes over the panel center O, further goes over the starting end portion 6*a* of the score 6 to overlap the opening expected portion 8 side, and the finger hook portion 13 of the tab 10 is arranged near a peripheral edge of the center panel 2 on the opposite side of the opening expected portion 8 with respect to the panel center O.

The finger hook portion 13 of the tab 10 linearly extends in a direction orthogonal to the second center line N, and the opposite end portions thereof reach side portions 16, 16 of the tab 10 via corner portions 13*c*, 13*c*, respectively. In addition, the tab 10 has an elliptical hole 14 formed therein adjacent to the finger hook portion 13, and in this example, the finger hook portion 13 is a narrow plate-like portion between a rear end 13*a* thereof and the hole 14.

As illustrated in FIG. 1B, a curled portion 17, which is formed by folding back a plate material constituting the tab 10 to a lower surface side, is formed over the entire periphery of the outer peripheral edge of the tab 10, and the curled portion 17 at the rear end 13*a* of the finger hook portion 13 is a flat portion 20 in which a central portion thereof in the direction orthogonal to the second center line N is flattened by a predetermined range (see FIG. 1C).

An embossed portion 9 locally recessed in a concave shape is formed in the vicinity of the rear end 13*a* of the finger hook portion 13 of the center panel 2, and further, dimples 30, 30 acting as convex portions are arranged in bilateral symmetry with respect to the second center line N in the vicinity of the opposite sides of the embossed portion 9. The embossed portion 9 is arranged in a region of the second panel surface 22 and close to the stepped portion 22*b* between the second panel surface 22 and the first panel surface 21. Hereinafter, the embossed portion 9 and the dimples 30 will be described in detail.

(Configuration of the Embossed Portion 9)

Figure 2A:
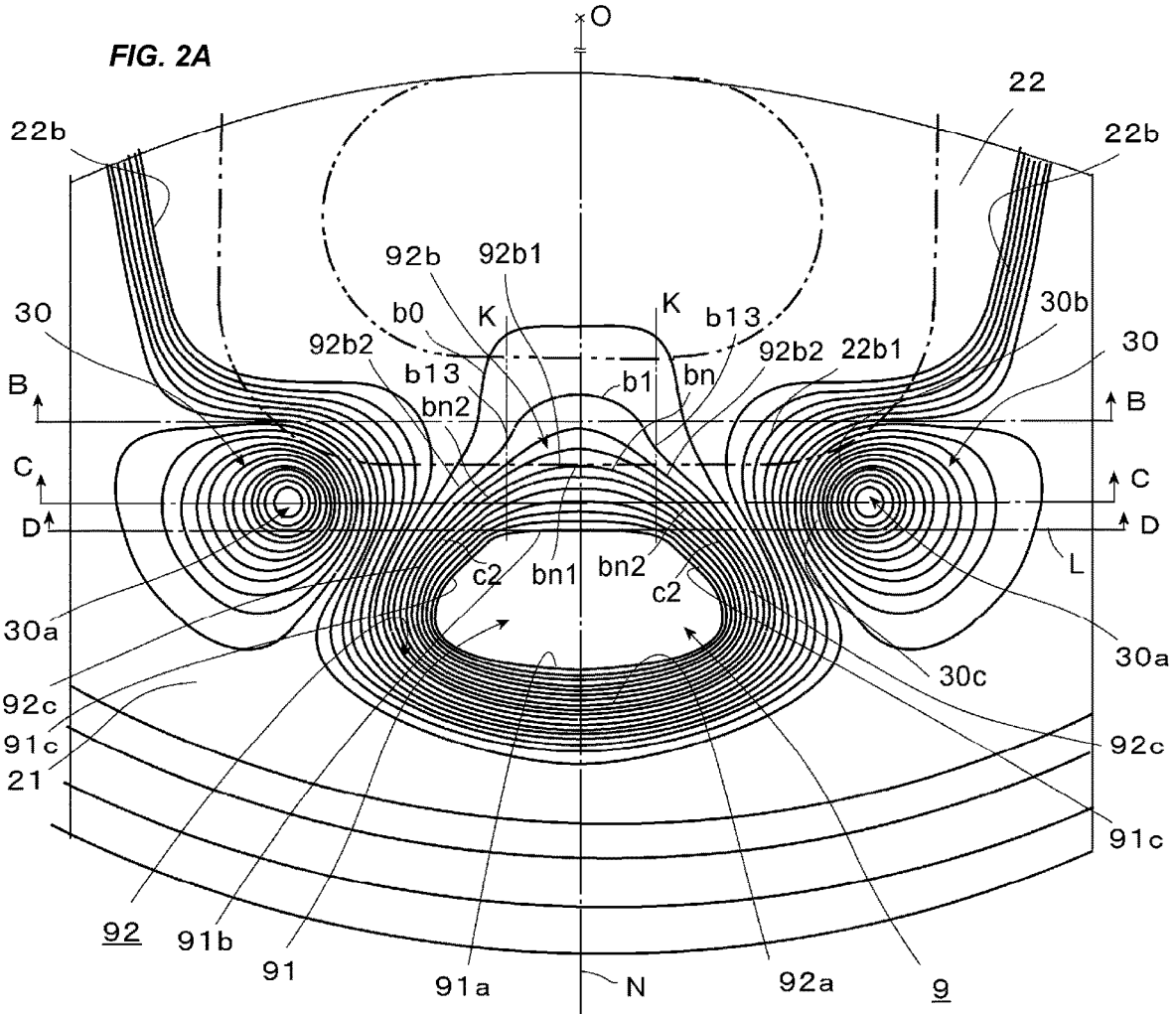
FIG. 2A is an enlarged plan view in which contour lines are provided in the vicinity of an embossed portion of FIG. 1A.

FIG. 2A shows the vicinity of the embossed portion 9 in an enlarged manner, and contour lines are added to clarify the undulating state. The contour lines are drawn at predetermined height intervals with a ground contact surface of the annular chuck wall radius 3 used as a horizontal plane, for example. Specifically, a distance from the first panel surface 21 to the bottom surface 91 of the embossed portion 9 is 1.1 mm±0.4 mm, and the number of contour line intervals is 17 at 1.1 mm.

The embossed portion 9 is formed on the second panel surface 22 at a predetermined depth, and is provided with a flat bottom surface 91 and an inner peripheral wall 92 surrounding the bottom surface 91. The bottom surface 91 has a trapezoidal shape line-symmetrical with respect to the second center line N, and includes a first side 91*a* at the opposite side (panel peripheral edge side) from the panel center O, a second side 91*b* at the panel center O side, and a pair of lateral sides 91*c*, 91*c* connecting between the opposite ends of the first side 91*a* and the opposite ends of the second side 91*b*, wherein the first side 91*a* and the lateral sides 91*c*, 91*c* bulge in an arc shape, and the second side 91*b* at the panel center O side is a straight line orthogonal to the second center line N. In addition, a corner between the first side 91*a* and the lateral side 91*c* is rounded.

The inner peripheral wall 92 of the embossed portion 9 is inclined in a direction expanding upward, and has a first slope 92*a* positioned at the opposite side of the panel center O, a second slope 92*b* at the enteral side of the can lid, and a pair of side slopes 92*c*, 92*c* connecting between the opposite ends of the first slope 92*a* and the opposite ends of the second slope 92*b*. The outline shape of the outer peripheral edge of the inner peripheral wall 92 is a fan or sector shape in which the outer peripheral edge of the first slope 92*a* is an arc of a fan and the tip of the second slope 92*b* is the center of the fan. The pair of side slopes 92*c*, 92*c* are inclined toward the panel center O side so as to gradually approach each other in line symmetry with respect to the second center line N.

The first slope 92*a* and the side slopes 92*c*, 92*c* are inclined surfaces whose upper edges continue to the first panel surface 21, and the second slope 92*b* is an inclined surface whose upper edge continues to the second panel surface 22. At positions of transition from the side slopes 92*c*, 92*c* to the second slope 92*b*, the stepped portion 22*b* is branched from the side slopes 92*c* to detour the dimples 30. The stepped portion 22*b* has a pair of detour portions 22*b*1 that are each continuous with a slope region 30*b* at a side of each dimple 30 facing the tab 10, thereby constituting a part of a slope of each dimple 30.

On the other hand, a lower approximately two thirds portion of each side slope 92*c* is connected to the second slope 92*b*.

The branching position of the stepped portion 22*b* from the second slope 92*b* is in the vicinity of a virtual branch line L passing through a linear second side 91*b* of the bottom surface 91, and a region of the inner peripheral wall 92 at the panel center O side from the virtual branch line L is defined as the second slope 92*b*. A plurality of contour lines in the second slope 92*b* are curved lines concaved toward the bottom surface 91 when viewed from the second panel surface 22, and it is shown that the contour lines are recessed in a valley shape having a portion thereof along the second center line N as a valley bottom.

The second slope 92*b* extends toward the panel center O at least up to a position facing the back surface of the finger hook portion 13, and in this embodiment, the entire second slope 92*b* constitutes a guide recess for guiding a fingertip in the present invention, and in addition, the side slopes 92*c* also constitute a part of the guide recess.

Now, the undulating state of the second slope 92*b* will be described with reference to the contour lines.

For the purpose of explanation, imaginary lines K, K passing through the opposite ends of the second side 91*b* of the bottom surface 91 and parallel to the second center line N are drawn, and a region of the second slope 92*b* sandwiched by the imaginary lines K, K is defined as a central region 92*b*1, and the other regions of the second slope 92*b* located at the opposite sides of the central region 92*b*1 with respect to the imaginary lines K, K and connected to the side slopes 92*c*, 92*c*, respectively, are defined as transition regions 92*b*2, 92*b*2.

The outer edge of the second slope 92*b* is a second contour line b1 viewed from the second panel surface 22 side, and a first contour line b0 located at the outer side of the second contour line b1 indicates a slight inclination of the second panel surface 22.

Assuming that the contour lines drawn toward the bottom surface, including the contour line b1, is denoted by bn, each contour line bn has a curved portion bn1, which is linearly symmetrical with respect to the second center line N and is curved in a convex arc shape toward the panel center O in the central region 92*b*1, and oblique line portions bn2, bn2, which extend from the opposite ends of the curved portion bn1 toward the side slopes 92*c*, 92*c* in the transition region 92*b*2. The oblique line portions bn2, bn2 extend line-symmetrically with respect to the second center line N, while being inclined in a direction in which the interval between them becomes narrower toward the panel center O. The oblique line portions bn2, bn2 are slightly curved outward (in the opposite direction with respect to the second center line N) in a convex manner, and are smoothly continuous with the contour lines c2, c2 in the side slopes 92*c*, 92*c*, respectively. On the other hand, connecting portions between the oblique line portions bn2, bn2 and the curved portion bn1 are also smoothly continuous, but in the contour line b1, they are smoothly connected with each other through a connecting portion b13 of an outwardly concave arc (i.e., concaved in the opposite direction with respect to the second center line N).

In addition, the intervals between the adjacent curved portions bn1 of the individual contour lines bn in the central region 92*b*1 are substantially constant from the bottom surface 91 to a predetermined height, and then increase therefrom toward the second panel surface 22. The intervals between the adjacent curved portions bn1 at the bottom surface side are as wide as about 2 times the intervals between the adjacent contour lines at the first slope 92*a* side. Therefore, the angle of inclination of the second slope 92*b* along the second center line N is a constant gentle angle smaller than the angle of inclination of the first slope 92*a* from the bottom surface 91 to the predetermined height, and then gradually becomes more gentle up to the second panel surface, so that the second slope 92*b* smoothly connects to the second panel surface 22.

The angle of inclination along the second center line N of the second slope 92*b* located at the rear end 13*a* side of the finger hook portion 13 is preferably set to be 5°-22° with respect to the bottom surface 91. This angle of inclination is the angle of a straight line portion of the second slope 92*b* shown in the cross section of (B) in FIG. 1 from the bottom surface 91 to a position not overlapping the tab 10.

Figure 2B:
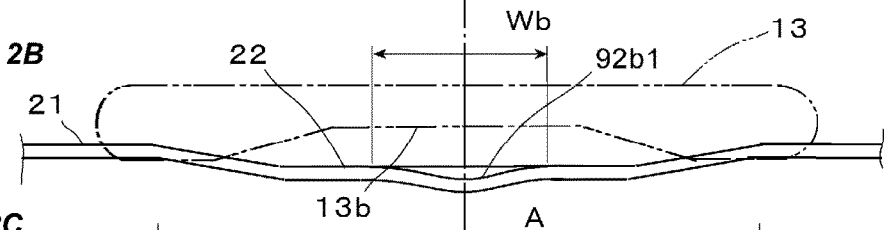
FIG. 2B is a cross section taken along line B-B of FIG. 2A.
Figure 2C:
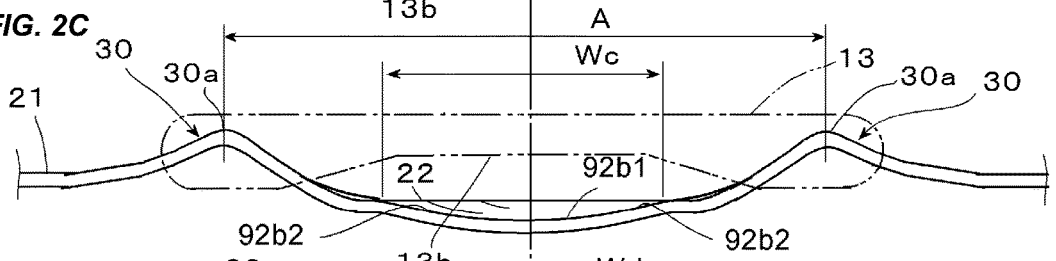
FIG. 2C is a cross section taken along line C-C of FIG. 2A.
Figure 2D:
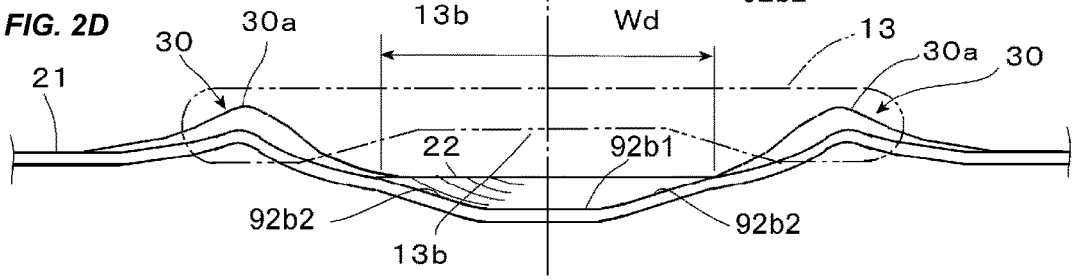
FIG. 2D is a cross section taken along line D-D of FIG. 2A.

In FIGS. 2B to 2D, FIGS. 2B through 2D are cross sections of the second slope 92*b* cut in a direction orthogonal to the second center line N.

FIG. 2D is a cross section taken along the second side 91*b* of the bottom surface 91, in which the central region 92*b*1 is linear, and the transition regions 92*b*2, 92*b*2 are straight inclined sides. An opening width of the second slope 92*b* on the second panel surface 22 in this cross section, i.e., a width (a width in the direction orthogonal to the second center line N) Wd between the upper ends of the inclined sides of the transition regions 92*b*2, 92*b*2, is a maximum width of the second slope 92*b*.

FIG. 2C is a cross sectional view cut at a position along the tops 30*a* of the dimples 30, in which the central region 92*b*1 has an arc shape slightly curved downward, with the depth thereof from the second panel surface 22 being shallow, and the transition regions 92*b*2, 92*b*2 are straight inclined sides. An opening width of the second slope 92*b* at the second panel surface side in this cross section, i.e., a width (a width in the direction orthogonal to the second center line N) Wc between the upper ends of the inclined sides of the transition regions 92*b*2, 92*b*2, is narrower than Wd.

FIG. 2B is a cross sectional view taken near the tip portion of the central region 92*b*1. In this position, there is no transition region, and an opening width (a width in the direction orthogonal to the second center line N) Wb on the second panel surface 22 is further narrower than Wc.

(Regarding Dimples 30)

The dimples 30, 30 are formed on the first panel surface 21 so as to protrude upward. When the dimples are formed on the first panel surface 21, it is possible to suppress the amount of decrease in sheet thickness when each dimple 30 is formed, which is more advantageous in terms of formability or moldability than when the dimples are formed on the second panel surface 22. In addition, a coating film coated on the surface is not damaged by excessive stretching.

The dimples 30, 30 are arranged in the vicinity of the corner portions 13*c*, 13*c* of the tab 10, and are basically provided to prevent accidental opening when cans are stacked, but in this embodiment, they have a function of guiding a fingertip.

That is, an interval A between the apexes 30*a*, 30*a* of the dimples 30, 30 in the direction orthogonal to the second center line N is set within a range of 13 mm±2 mm. The interval A between the apexes 30*a*, 30*a* is the distance between the apexes 30*a*, 30*a* or highest points (see FIG. 2C). The shape of the dimples 30, 30 may be a trapezoidal shape with a flat top, and in that case, the interval A is set as a minimum distance between the peripheral edges of their top surfaces in the direction orthogonal to the second center line N.

The interval A between the tops 30*a*, 30*a* of the dimples 30, 30 is set based on the index fingernail central finger-breadth N12, the male and female average (M+F): 13.3 mm, in "Japanese Hand Size Data" supervised by AIST (National Institute of Advanced Industrial Science and Technology). Since this data is the breadth of the finger at an intermediate position from the base of nail to the fingertip, the interval A is set to be slightly smaller in this embodiment in consideration of the fact that the fingertip is thinner than the intermediate position.

A detailed look at the contour lines of the dimples 30, 30 shows that the planar shape of the root portion of each dimple is a rounded triangular shape with three sides bulged outward, the middle portion thereof gradually transitions to a circular shape toward the apex thereof, and the top 30*a* of each dimple 30 is displaced toward the detour portion 22*b*1 side of the stepped portion 22*b* so that it is arranged close to a corner portion 13*c* of the tab 10. The slope regions 30*b* facing the corner portions 13*c* of the tab 10 are respectively located in the detour portions 22*b*1 of the stepped portion 22*b*, the detour portions 22*b*1 are respectively continuous with the slope regions 30*b* of the dimples 30 to constitute parts of the slopes of the dimples 30, and the detour portions 22*b*1 spreading to the second panel surface 22 side protrude so as to overlap the back surface side of the corner portions 13*c* of the tab 10. On the other hand, the slope regions 30*c* of the dimples 30 facing the side slopes 92*c* of the embossed portion 9 are respectively inclined surfaces continuous with the side slopes 92*c* of the embossed portion 9.

Next, the operation of the can lid of this embodiment will be described with reference to FIGS. 3A to 3C and 4A to 4D.

Figure 3A:
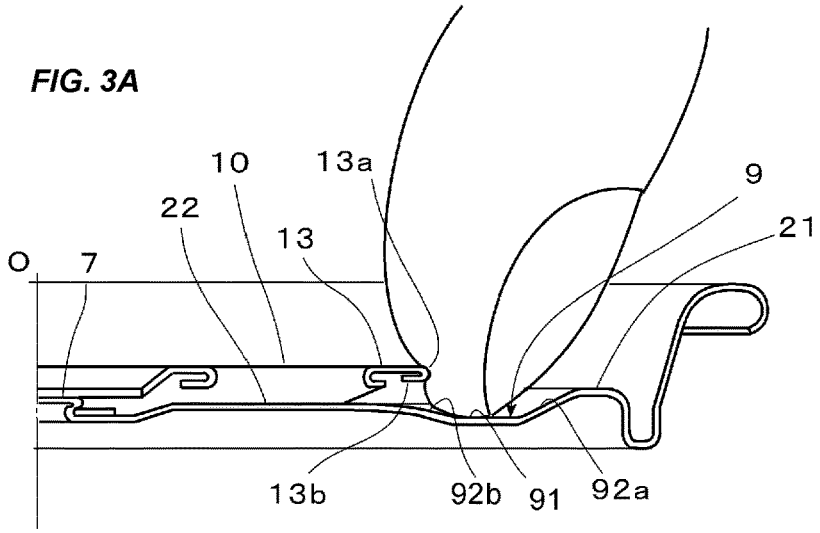
FIGS. 3A to 3C are explanatory views of a tab pulling-up operation.
Figure 4A:
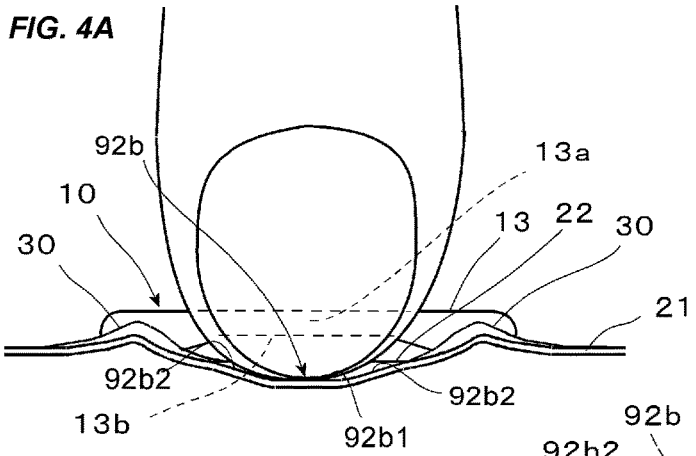
FIGS. 4A to 4C are explanatory views of the pulling-up operation when

In an opening operation, first, a fingertip is inserted into the embossed portion 9, so that the fingertip is hooked on the rear end 13*a* of the finger hook portion 13 of the tab 10 (see FIG. 3A and FIG. 4A).

Figure 4D:
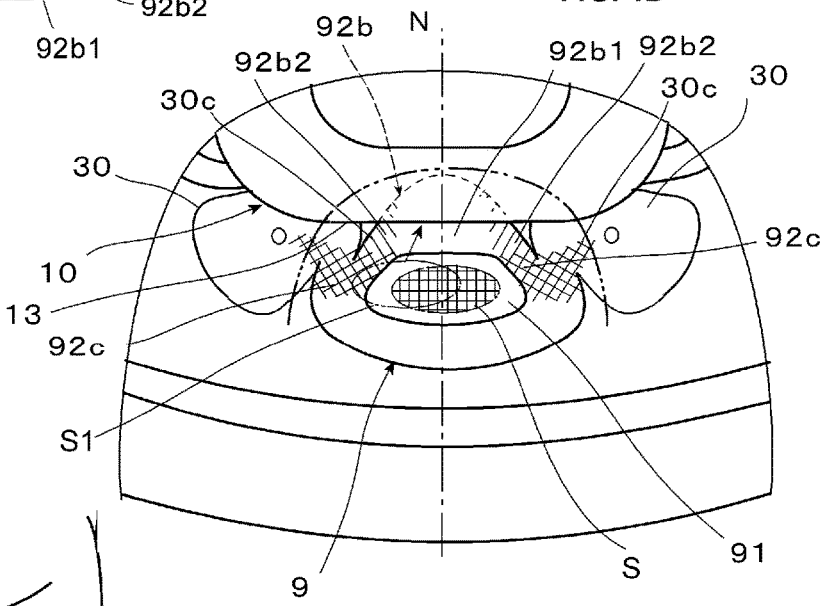
FIG. 4D is an action explanatory view of side slopes.
Figure 4B:
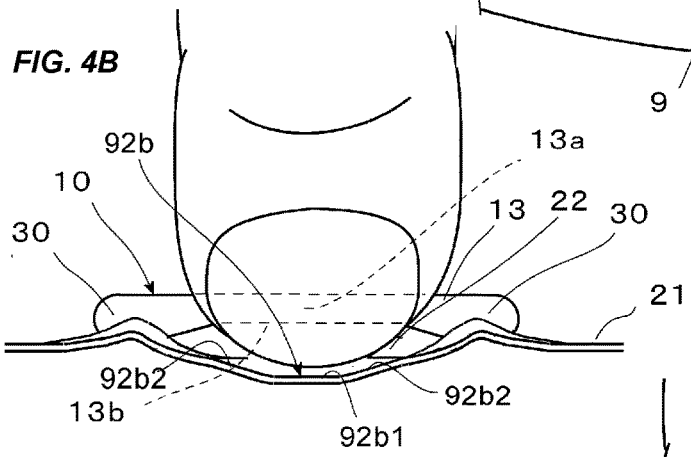
Figure 4C:
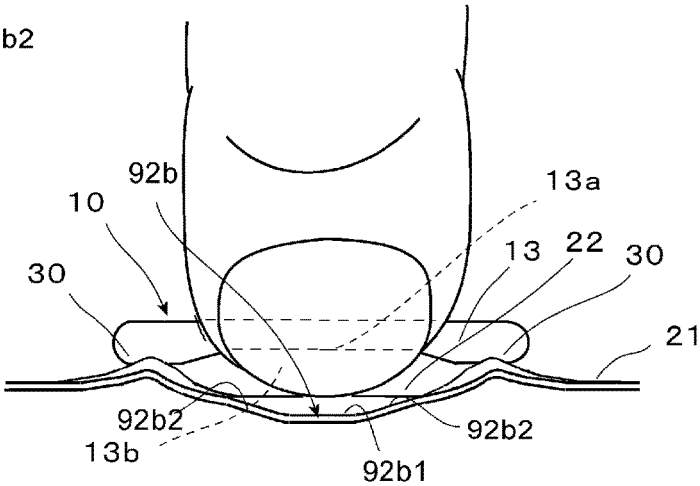

Here, with reference to FIG. 4D, the operation of the side slopes 92*c*, 92*c* until the fingertip is guided from the bottom surface of the embossed portion 9 to the second slope 92*b* will be described. In the figure, the side slopes 92*c*, 92*c* and the slope regions 30*c*, 30*c* of the dimples 30, 30 continuous with the side slopes 92*c*, 92*c* are hatched in an diagonal grid pattern, and the transition regions 92*b*2, 92*b*2 of the second slope 92*b* continuous with the side slopes 92*c*, 92*c* are hatched obliquely. In addition, a portion hatched in a vertical and horizontal grid pattern schematically indicates a region of an abutment portion S in which a fingertip portion of FIG. 3A is in abutment with the bottom surface 91.

In the initial stage of pulling up, the abutment portion S moves from the bottom surface 91 toward the second slope 92*b*, but since the side slopes 92*c*, 92*c* are inclined in a direction closer to the second center line N toward the panel center, even if the abutment portion S deviates from the second center line N toward one side slope 92*c*, as shown by S1 in the figure, the abutment portion S moves toward the second slope 92*b* while correcting the deviation in a direction closer to the second center line N as shown by an arrow in the figure, so that it is directed in a direction along the second center line N, i.e., in a direction toward the panel center O, and further, even after reaching the second slope 92*b*, it is continuously guided by the transition regions 92*b*2, 92*b*2 of the second slope 92*b* continuous with the side slopes 92*c*, 92*c*.

In particular, in this embodiment, the slope regions 30*c*, 30*c* of the dimples 30, 30 facing the side slopes 92*c*, 92*c* are the inclined surfaces continuous with the side slopes 92*c*, 92*c* of the embossed portion 9, and hence, not only the abutment portion S of the fingertip but also the side faces of the fingertip are restricted from moving in a direction away from the second center line N by the slope regions 30*c*, 30*c* of the dimples 30, 30, so that the moving direction of the fingertip can be more effectively guided in the direction along the second center line N.

Figure 3B:
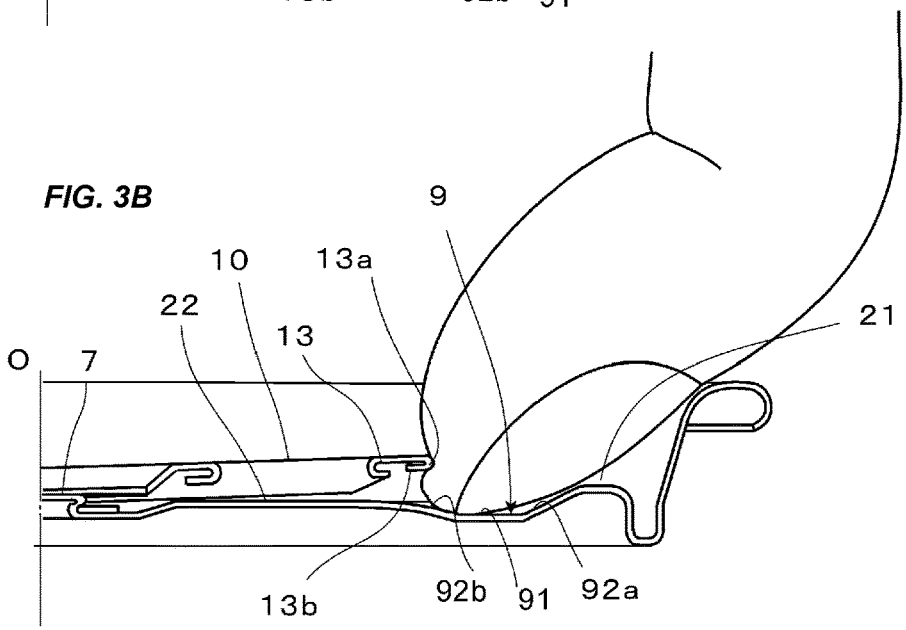
Figure 3C:
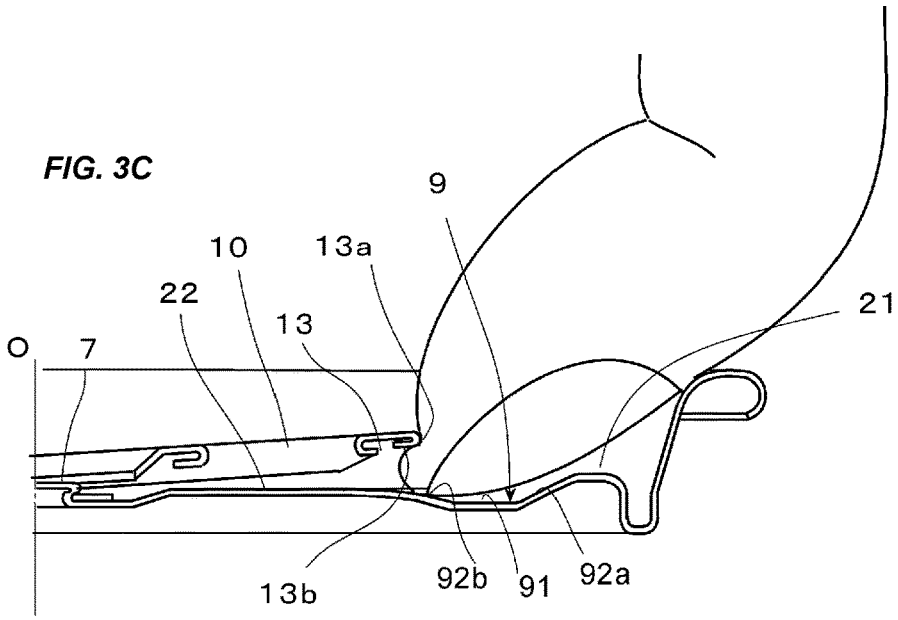

Then, as illustrated in FIG. 3B, the tab 10 is pulled upward. In the initial stage of pulling up, as illustrated in FIG. 3B and FIG. 3C, the fingertip portion is guided from the bottom surface 91 of the embossed portion 9 along the inclined surface of the central region 92*b*1 of the valley-shaped second slope 92*b* to the central portion in the width direction of the back surface of the finger hook portion 13 along the second center line N (see FIG. 4B and FIG. 4C). That is, in the second slope 92*b*, the central region 92*b*1 is located at a position deeper than the left and right transition regions 92*b*2, 92*b*2, and the fingertip is automatically guided to a deep position of the central region 92*b*1 by means of the pull-up reaction acting on the fingertip from the tab 10.

In addition, when the second slope 92*b* is cut in the direction orthogonal to the second center line N, the opening width of the second slope 92*b* in the second panel surface 22 is wide at the bottom surface 91 side of the embossed portion 9, and gradually narrows toward the panel center O, so that the finger is naturally guided to the central portion in the width direction of the back surface of the finger hook portion 13.

Further, the central region 92*b*1 serving as the valley bottom of the second slope 92*b* is a gentle slope toward the panel center O along the second center line N, and hence, the tab 10 is pulled up as the fingertip is gradually lifted.

In particular, in this embodiment, since the interval A between the dimples 30, 30 is set to about 13 mm, the fingertip passes between the left and right dimples 30, 30 while being guided by the second slope 92*b*, so that the fingertip is guided to the central region 92*b*1 of the second slope 92*b* from a finger hooking stage without being deviated to the left and right.

In this way, in the initial stage of pulling up the tab 6 by hooking the finger on the rear end of the finger hook portion 13, the second slope 92*b* guides the path of the fingertip along the second center line N to the center in the width direction of the back surface of the finger hook portion 13, and hence, in the later pulling-up operation, the direction of a pulling-up force does not obliquely deviate significantly from the direction of the panel center O, so that the pulling-up force can be concentrated on the score starting end portion 6*a* in the vicinity of the rivet portion 7 through the tab tip end portion 11 thereby to break the score 6.

Then, the prevention of accidental opening by the dimples 30 as well as formability thereof in the present embodiment will be described.

The can lid of the present invention can be used in both a negative pressure can and a positive can, and is not limited to a positive pressure can, but regarding the prevention of accidental opening of positive pressure cans, which are subject to severe conditions, the height of the dimples 30 on can lids was changed to examine catching or snagging between a leg portion of a bottom of an upper can and a tab of a can lid of a lower can when stacked in a pile, and it was found that when the height was smaller than 0.5 mm, the snagging occurred easily, whereas when the height was equal to or greater than 0.5 mm, the snagging was less likely to occur, and unintentional or accidental opening was able to be prevented.

The height h of the dimples 30 is a height from the second panel 22 that is one step or level lower than the first panel 21, as illustrated in FIG. 1B and FIG. 1C.

The higher the height of the dimples 30 is, the more difficult it is for the tab of the lower can lid to be snagged or caught by the leg of the upper can bottom, but if the protrusion height exceeds 1.2 mm, the wall thickness of the dimples 30 becomes thin and cracks may occur. As a result of intensive studies, it was found that the height of dimples is preferably 0.5 mm or more and 1.2 mm or less from the point of view of prevention of accidental opening and formability. More preferably, it is 0.5 mm or more and 1.2 mm or less, and further preferably, it is 0.8 mm or more and 1.2 mm or less.

In order to examine the height of the dimples, an evaluation test was conducted on the accidental opening and formability. The evaluation test will be described below.

In the evaluation test, with respect to the can lid of the above-described embodiment, four types of can lid samples in which the height of the dimples 30 was changed were prepared, and two types of can main bodies with different leg shapes of the can bottoms were each filled with a content to be a positive pressure in a sealed state, after which the can lids were seamed and fixed thereto to produce positive pressure cans, and the unintentional openability and formability were evaluated.

Figure 5A:
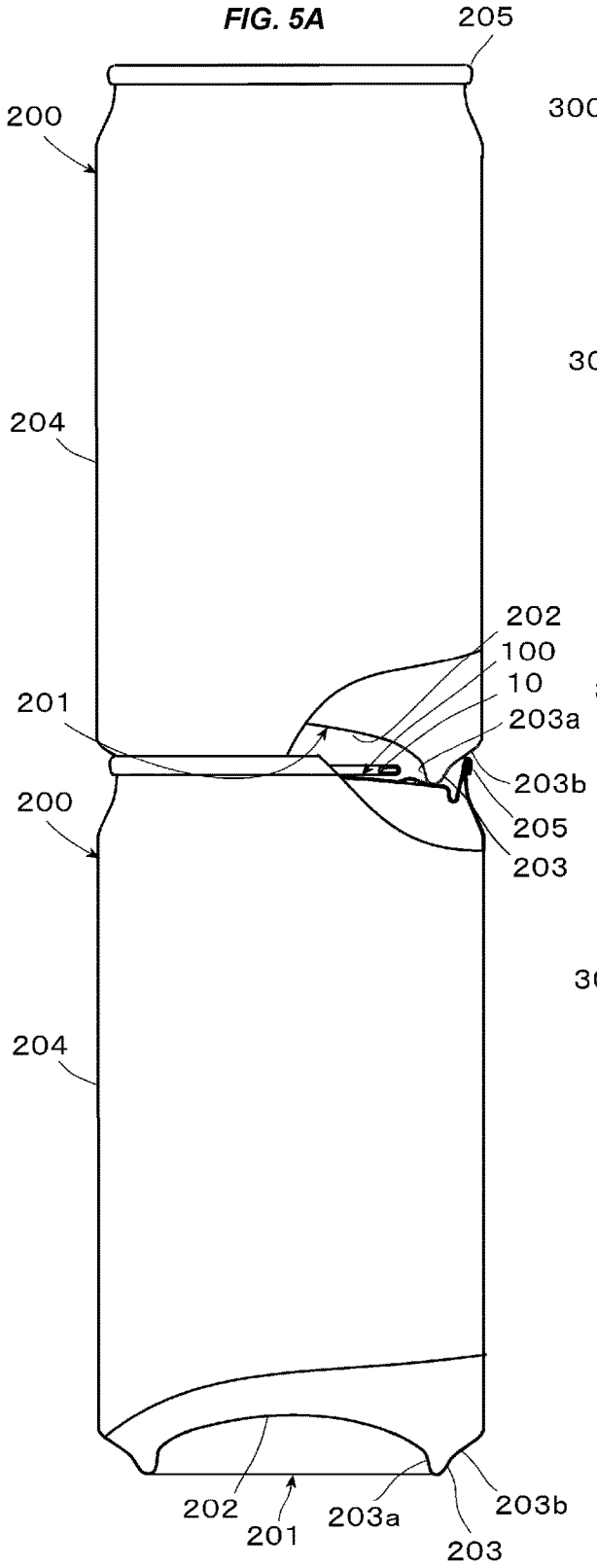
Figure 5B:
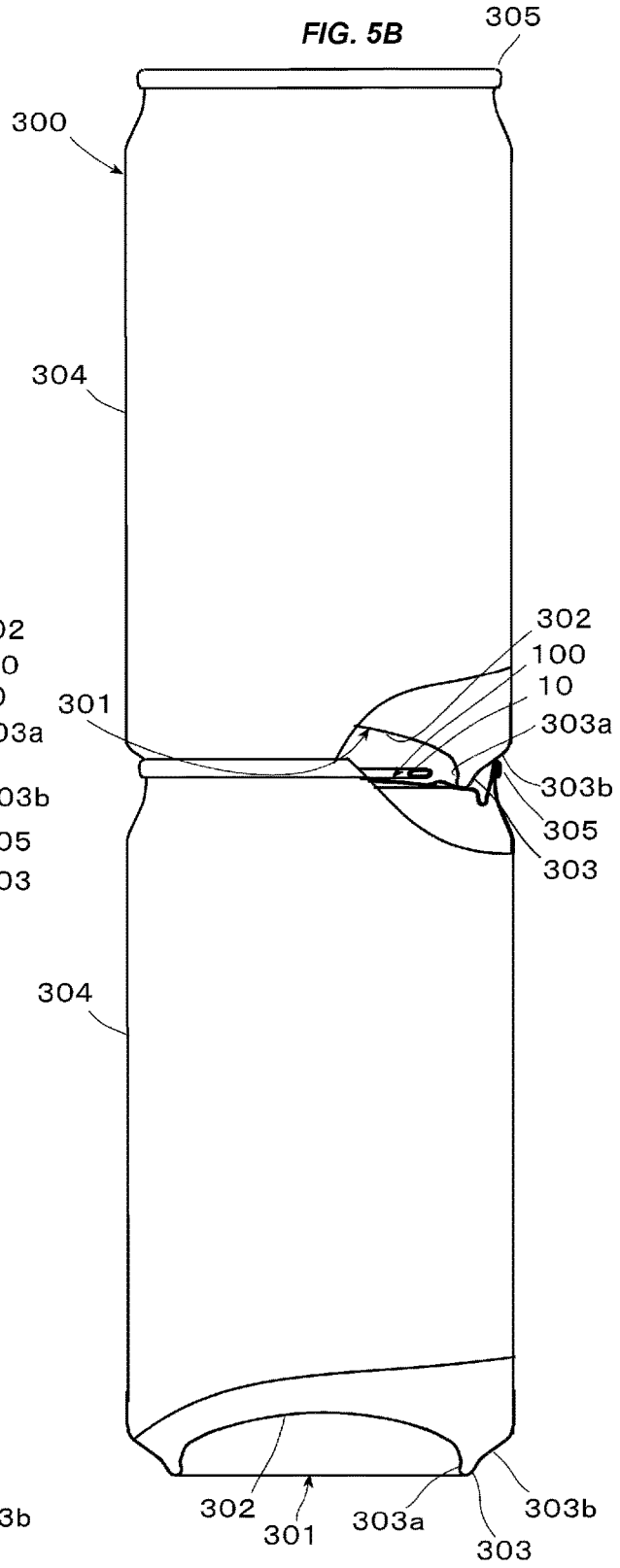

First, class 1 type can bodies 200 and class 2 type can bodies 300 used in the evaluation test will be described with reference to FIGS. 5A and 5B. FIG. 5A shows the class 1 type can bodies 200, and FIG. 5B shows the class 2 type can bodies 300, in each of which the can bodies are stacked in two tiers or stages. In these figures, the can lids are denoted by reference numeral 100.

The class 1 type can bodies 200 are each a 2-piece can, as illustrated in FIG. 5A, and the can lids 100 are each seamed and fixed to the open end of each body portion 204 to form a seamed portion 205. Each can bottom 201 has a dome portion 202 recessed in a concave shape toward the inside of a can, and an annular first shaped leg portion 203 projecting downward from an outer peripheral edge of the dome portion 202, and when positive pressure cans are vertically stacked, the first shaped leg portion 203 of the can bottom 201 of an upper can is placed at a position close to the finger hook portion 13 of the tab 10 on the can lid 100 of a lower can. An inner peripheral surface 203*a* of the first shaped leg portion 203 is an inclined surface that is inclined in a direction in which its diameter becomes smaller toward the inside of the can. In addition, an outer peripheral surface 203*b* of the first shaped leg portion 203 is inclined in a direction in which its diameter gradually increases in an upward direction.

The class 2 type can bodies 200 are each a 2-piece can, as illustrated in FIG. 5B, and the can lids 100 are each seamed and fixed to the open end of each body portion 304 to form a seamed portion 305. Each can bottom 301 also has a dome portion 302 recessed in a concave shape toward the inside of a can, and an annular second shaped leg portion 303 projecting downward from an outer peripheral edge of the dome portion 302, as illustrated in FIG. 5B, and when cans are vertically stacked, the second shaped leg portion 303 of the can bottom 301 of an upper can is placed at a position close to the finger hook portion of the tab on the can lid 100 of a lower can. The second shaped leg portion 303 is referred to as a bottom reformed shape. In this second can body 300, the inner peripheral surface 303*a* of the second shaped leg portion 303 is an inclined surface that is inclined in a direction in which its diameter becomes larger in a direction toward a radial direction (in an expanding direction), and the second shaped leg portion 303 of the upper can bottom 301 is more easily snagged or caught, when stacked, by the tab of the can lid 100 of the lower can body than in the case of the class 1 type can body 200.

Next, a snagging state in which a first shaped leg portion 203 and a tab 10 of the class 1 type can bodies 200 are caught with each other will be described with reference to FIG. 6.

Figure 6:
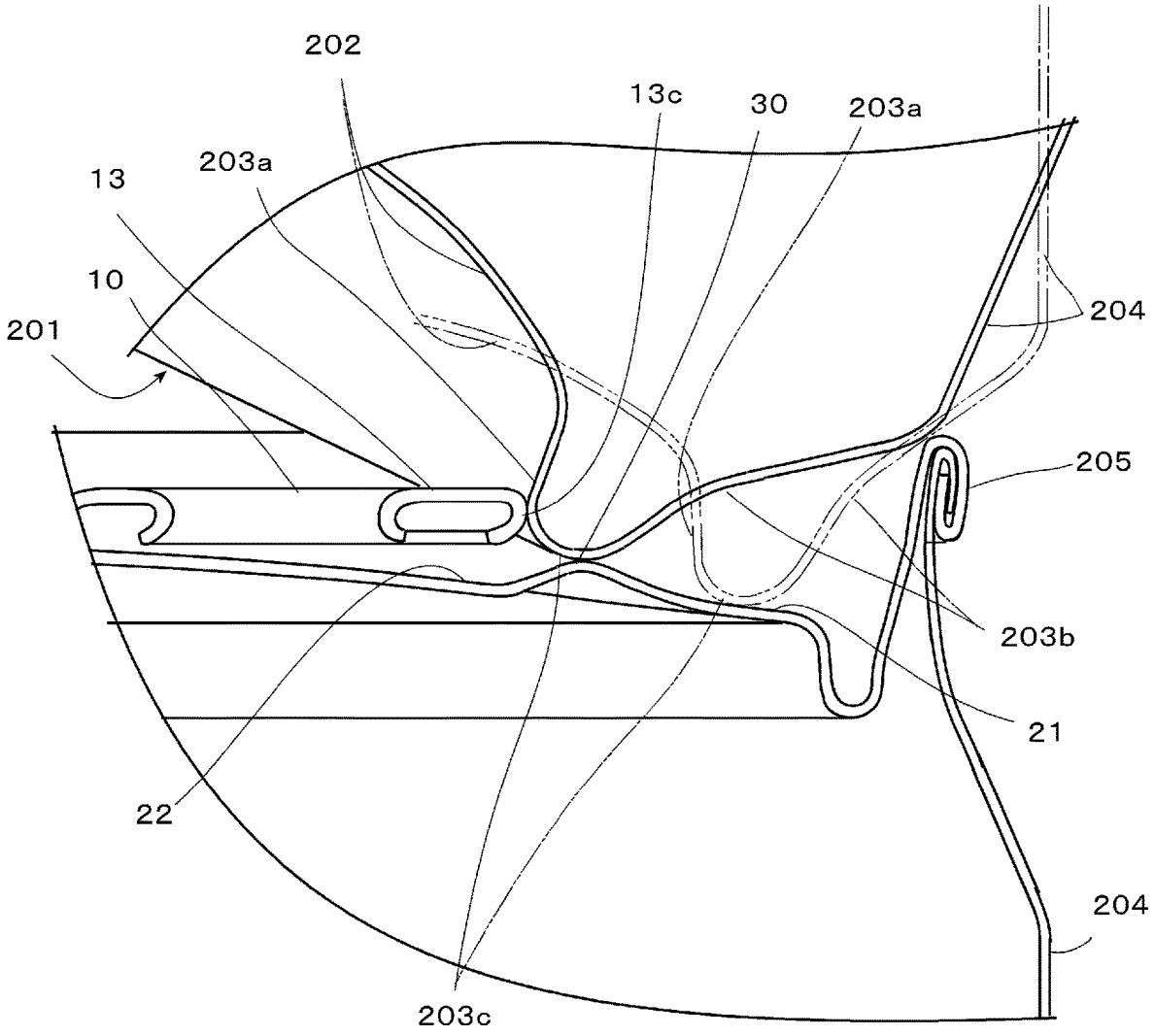
FIG. 6 is an enlarged cross sectional view of main parts of stacked portions of a first can body of FIG. 5A.

FIG. 6 is an enlarged cross sectional view of main parts of stacked portions of the first can bodies 200 in FIG. 5A, in which the first shaped leg portion 203 in a normally stacked state is indicated by an alternate long and two short dashes line, and the first shaped leg portion 203 in an inclined state is indicated by a solid line. The cross section is taken at a corner 13*c* of the tab 10.

In the normally stacked state, as shown by the alternate long and two short dashes line, a lower end 203*c* of an arc shape in cross section of the first shaped leg portion 203 is in contact with the first panel surface of the can lid 100 of the lower can, and the outer peripheral surface 203*b* of the first shaped leg portion 203 is in contact with an upper end of the seamed portion 205 of the lower can.

In this state, when the upper can is tilted, as shown by the solid line, the outer peripheral surface 203*b* of the first shaped leg portion 203 rides on the seamed portion 205, and the lower end portion 203*c* of the arc shape in cross section rides on the dimple 30 and comes into contact with a corner portion 13*c* of the finger hook portion 13. Further tilted from this state, the leg portion 203 is caused to move in a direction to snag or lift the tab 10 upwardly, and if such a snag is strong, an unintentional or accidental opening will occur due to the action of leverage.

Further, a snagging state in which a first shaped leg portion 303 and a tab 10 of the class 2 type can bodies 300 are caught with each other will be described with reference to FIG. 7.

Figure 7:
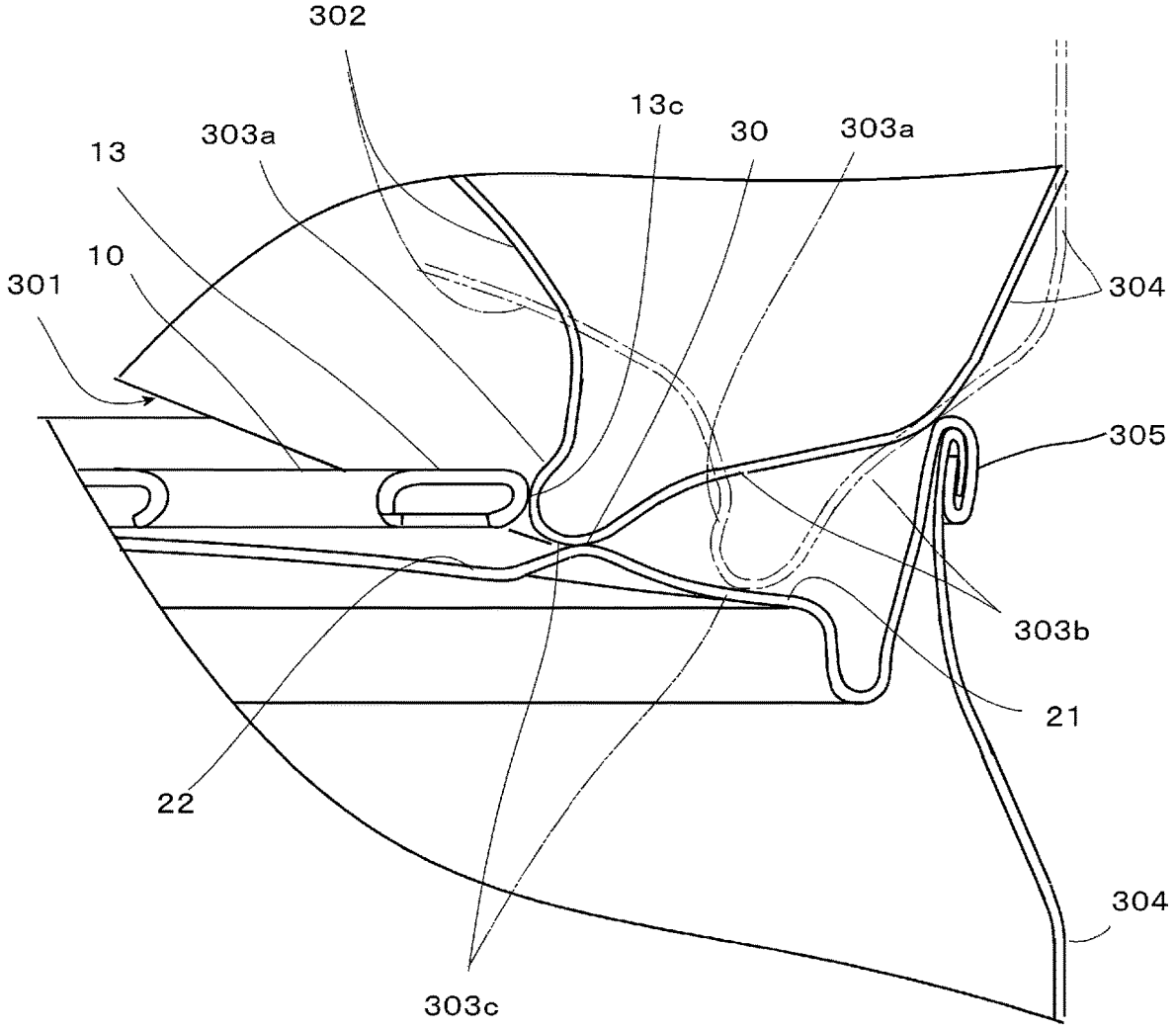
FIG. 7 is an enlarged cross sectional view of main parts of stacked portions of a second can body of FIG. 5B.

FIG. 7 is an enlarged view of main parts of stacked portions of the second can bodies 300 in FIG. 5B, in which the first shaped leg portion 303 in a normally stacked state is indicated by an alternate long and two short dashes line, and the second shaped leg portion 303 in an inclined state is indicated by a solid line. The cross section is taken at a corner 13*c* of the tab 10.

In the normally stacked state, as shown by the alternate long and two short dashes line, a lower end 303*c* of an arc shape in cross section of the second shaped leg portion 303 is in contact with the first panel surface of the can lid 100 of the lower can, and the outer peripheral surface 303*b* of the second shaped leg portion 303 is in contact with an upper end of the seamed portion 305 of the lower can lid.

In this state, when the upper can is tilted, as shown by the solid line, the outer peripheral surface 303*b* of the second shaped leg portion 303 rides on the seamed portion 305, and the lower end portion 303*c* of the arc shape in cross section rides on the dimple 30 and comes into contact with a corner portion 13*c* of the finger hook portion 13. Further tilted from this state, the second shaped leg portion 303 is caused to move in a direction to snag or lift the tab 10 upwardly, and if such a snag is strong, an unintentional or accidental opening will occur due to the action of leverage. The inner peripheral surface 303*a* of the second shaped leg portion 303 is inclined in a direction in which its diameter increases toward the inside (upward) of the can, so it is easily snagged or caught by a corner portion of the finger hook portion 13 to the extent of such an inclination.

The heights of the dimples 30 of the four types of can lids described above were of four kinds: 0.7 mm, 0.8 mm, 1.0 mm, and 1.2 mm.

The diameter of each can lid 100 was 57.15 mm, the thickness thereof was 0.235 mm, and the internal pressure was set to 200 kPa at room temperature for both the first can bodies 200 and the second can bodies 300.

Each can lid 100 was expanded outwardly by the internal pressure, each tab 10 was lifted up from the second panel surface 22, and a clearance of each tab from the lifted second panel surface 22 is about 2.3 mm.

<Test for Checking Snagging between Leg Portion of Can Bottom and Tab>

In a test, the can bodies (positive pressure) to be evaluated, which were filled with contents, were stacked in two upper and lower tiers, as illustrated in FIGS. 5A and 5B, and the first can bodies 200 and the second can bodies 300 were relatively evaluated for the presence or absence of snagging when they were tilted by hand in the direction in which the leg portion of the can bottom was caught or snagged by the tab, and the evaluation results were rated in three levels of ◎, ○ and Δ. The evaluation levels were as follows.

◎: There was no snagging between the leg portion of the can bottom and the tab, and there was no occurrence of accidental opening.

○: Snagging between the leg portion of the can bottom and the tab was very slightly felt, but no accidental opening occurred.

Δ: Slight snagging of the tab on the bottom of the can was slightly felt, but no accidental opening occurred.

<Method for Checking Partial Reduction in Plate Thickness of Dimples 30>

From the cross sectional shapes of the dimples 30, the presence or absence of partial reduction in sheet thickness thereof was checked, and the formability of the dimples 30 were relatively evaluated.

◎: Very slight partial reduction in sheet thickness of the dimples 30, but still suitable for practical use Δ: Slight partial reduction in sheet thickness of the dimples 30, but still suitable for practical use Evaluation Results Regarding Unintentional Opening As illustrated in Table 1, all of the samples of the can bottom in the class 1 type can bodies were "◎", and there was no snagging at all without occurrence of accidental opening.

In the samples of the can bottom in the type 2 can bodies, "Δ" was given in 0.7 mm, "○" was given in 0.8 mm, and "◎" was given in 1.0 mm and 1.2 mm, and there was neither snagging nor accidental opening.

It is considered that there is slight abutment in 0.7 mm, but accidental opening can be prevented in case of about 0.5 mm.

Regarding Formability

As shown in Table 1, formability was evaluated as "◎" in all of 0.7 mm, 0.8 mm and 1.0 mm, and the reduction in sheet thickness was very slight, and hence, there was no problem in practical use, and it is suitable for practical use. In addition, in 1.2 mm, the reduction in the sheet thickness was slight, and it was evaluated to be suitable for practical use.

Here, note that in the above-mentioned embodiment, the slope at the rear end side of the finger hook portion of the embossed portion is configured to include the guide recess for guiding a fingertip that extends toward the center of the can lid at least up to a position facing the central portion in the width direction of the back surface of the finger hook portion, but only the dimples may be provided, while omitting the guide recess.

The movable range of a finger in the short side direction of the tab is limited by the pair of the dimples, so that a fingertip is guided to the central portion in the width direction of the finger hook portion, thereby making it easy to direct the pulling-up direction of the tab toward the central direction of the lid.

TABLE 1

| Hight of dimples (convex portions) 30 [mm] | Presence or absence of snagging of first shaped leg portion 203 and tab 10 | Presence or absence of snagging of second shaped leg portion 303 and tab 10 | Presence or absence of reduction in partial sheet thickness of dimples 30 |
|---|---|---|---|
| 0.7 | ◎ | Δ | ◎ |
| 0.8 | ◎ | ○ | ◎ |
| 1.0 | ◎ | ◎ | ◎ |
| 1.2 | ◎ | ◎ | Δ |

Here, note that in the above-mentioned embodiment, the finger hook portion 13 is formed in a linear shape, but a step-shaped or arch-shaped tip-up portion may be provided in the central portion in the width direction of the finger hook portion 13. In addition, in the above embodiment, the hole 14 is provided in the tab 10, but the hole 14 may be omitted.

In addition, the center panel 2 is configured to include the first panel surface 21 and the second panel surface 22, which is lower than the first panel surface, but the second panel surface 22 may be omitted. Moreover, the rivet portion 7 is provided in the panel center of the center panel, but the rivet portion 7 does not need to be located at the panel center position, and the rivet portion 7 may be shifted from the panel center on the second center line.

The invention claimed is:

1. A can lid in which a tab for score breaking is fixed to a can lid main body, and an embossed portion, into which a fingertip is insertable, is provided in the vicinity of a rear end of a finger hook portion of the tab, wherein the embossed portion has a bottom surface and an inner peripheral wall surrounding the bottom surface; the inner peripheral wall has a first slope at a side opposite to the center of a can lid, a second slope at a central side of the can lid, and a pair of side slopes connecting to opposite ends of the first slope and the second slope, wherein when assuming a center line that passes through the center of the can lid and a center of the finger hook portion, the second slope is recessed in a valley shape having a portion thereof along a center line as a valley bottom, wherein the second slope extends toward a center of the can lid at least up to a position facing a back surface of the finger hook portion, wherein the can lid main body is provided with convex portions in the vicinity of a rear end of the finger hook portion of the tab at opposite sides of the embossed portion that is sandwiched therebetween, wherein the can lid main body has a circular center panel, which has a first panel surface at an outer peripheral edge side thereof and a second panel surface at an inner side of the first panel surface, the second panel surface being lower by one step than an inner peripheral edge of the first panel surface via a stepped portion, and the convex portions are provided on the first panel surface, wherein the planar shape of the root portion of each convex portion is a rounded triangular shape with three sides bulged outward, the middle portion thereof gradually transitions to a circular shape toward the apex thereof, wherein the top of each convex portion is displaced toward a detour portion side of the stepped portion so that it is arranged close to a corner portion of the tab, wherein the slope regions facing the corner portions of the tab are respectively located in the detour portions of the stepped portion, and wherein the detour portions are respectively continuous with the slope regions of the convex portions to constitute parts of the slopes of the convex portions and the detour portions spreading to the second panel surface side protrude so as to overlap the back surface side of the corner portions of the tab.

2. The can lid according to claim 1, wherein a width of the second slope in a direction orthogonal to the center line is gradually narrowed toward a central direction of the can lid.

3. The can lid according to claim 2, wherein the pair of side slopes are inclined in a direction gradually approaching toward the can lid center side.

4. The can lid according to claim 3, wherein the convex portions have slopes at the side of the embossed portion, the slopes comprising inclined surfaces continuous with the side slopes of the embossed portion.

5. The can lid according to claim 1, wherein the second slope comprises an inclined surface that gradually becomes shallower from a bottom surface of the embossed portion toward the center of the can lid, and the inclined surface has an angle of inclination smaller than that of the first slope.

6. The can lid according to claim 1, wherein each of the convex portions has a height in a range of 0.5 mm or more and 1.2 mm or less.

7. The can lid according to claim 1, wherein a distance between apexes of the convex portions is in a range of 13 mm±2 mm.

8. The can lid according to claim 1, wherein the second slope comprises a central region along the center line and transition regions connected to the side slopes, and wherein the angle of inclination of the second slope along the center line is a constant gentle angle smaller than the angle of inclination of the first slope from the bottom surface to the predetermined height, and then gradually becomes more gentle in a region in facing a back surface of the finger hook portion.

9. The can lid according to claim 8, wherein the bottom surface includes a first side at the opposite side from the panel center, a second side at the panel center side, and a pair of lateral sides connecting between the opposite ends of the first side and the opposite ends of the second side, and wherein a region of the second slope sandwiched by imaginary lines passing through the opposite ends of the second side is defined as the central region.

10. The can lid according to claim 1, wherein the outline shape of the embossed portion is a sector shape in which the outer peripheral edge of the first slope is an arc of a fan and the tip of the second slope is the center of the fan, and the pair of side slopes are inclined toward the center of a can lid so as to gradually approach each other with respect to the center line.

11. The can lid according to claim 1, wherein the first slope and the side slopes have upper ends continuing to the first panel surface and the second slope has an upper end continuing to the second panel surface, and wherein the stepped portion is branched from the side slopes to detour the convex portions at positions of transition from the side slopes to the second slope, and the stepped portion has a pair of detour portions that are each continuous with a slope region at a side of each convex portions facing the tab, thereby constituting a part of a slope of each convex portions, and a lower portion of each side slope is connected to the second slope.

* * * * *